US008698478B2

(12) United States Patent
Hong

(10) Patent No.: US 8,698,478 B2
(45) Date of Patent: Apr. 15, 2014

(54) REFERENCE VOLTAGE GENERATION CIRCUIT

(75) Inventor: Cheng Hong, Shanghai (CN)

(73) Assignee: Ricoh Company, Ltd., Tokyo (JP)

( * ) Notice: Subject to any disclaimer, the term of this patent is extended or adjusted under 35 U.S.C. 154(b) by 171 days.

(21) Appl. No.: 13/040,545

(22) Filed: Mar. 4, 2011

(65) Prior Publication Data

US 2011/0221406 A1 Sep. 15, 2011

(30) Foreign Application Priority Data

Mar. 11, 2010 (CN) ..... 2010 1 0131284

(51) Int. Cl.
*G05F 3/16* (2006.01)
*G05F 3/20* (2006.01)

(52) U.S. Cl.
USPC ..... 323/313

(58) Field of Classification Search
USPC ..... 323/266, 351, 284, 371, 268, 271–274, 323/280–282, 311–316; 327/72, 73, 327/538–543
See application file for complete search history.

(56) References Cited

U.S. PATENT DOCUMENTS 5,856,756 A * 1/1999 Sasahara et al. ..... 327/540
6,201,435 B1 3/2001 Chou
6,418,075 B2 * 7/2002 Shimano et al. ..... 365/227
6,570,371 B1 * 5/2003 Volk ..... 323/315
7,385,377 B2 * 6/2008 Pisasale et al. ..... 323/267
2004/0027906 A1 * 2/2004 Itou ..... 365/226
2006/0132114 A1 * 6/2006 Giduturi et al. ..... 323/313
2008/0116862 A1 5/2008 Yang et al.
2010/0201283 A1 * 8/2010 Kawata et al. ..... 315/287

OTHER PUBLICATIONS

E.Oxner et al., "Depletion-mode mosfet expand circuit opportunities", Temic semiconductors, pp. 1-5, Jun. 21, 1994.*
Chinese official action dated Apr. 3, 2013 and English translation in corresponding Chinese patent application No. 2010 10 13 1284.X.

* cited by examiner

*Primary Examiner* — Jessica Han
*Assistant Examiner* — Carlos Rivera-Perez
(74) *Attorney, Agent, or Firm* — Cooper & Dunham LLP

(57) ABSTRACT

A reference voltage generation circuit comprising a reference voltage generation and comparison unit, a drive unit, and M drive unit candidate circuits is provided in which the reference voltage generation and comparison unit generates reference voltage, and an output voltage output from the reference voltage generation circuit is input into the reference voltage generation and comparison unit as a negative feedback voltage. After being compared with the reference voltage, the output voltage is output from the reference voltage generation and comparison unit to the drive unit and the M drive unit candidate circuits. When power supply voltage of the reference voltage generation circuit varies, after being driven by the drive unit and the M drive unit candidate circuits, the output voltage is output to an output terminal of the reference voltage generation circuit so that the output voltage can be stabilized at the level of the reference voltage.

11 Claims, 6 Drawing Sheets

REFERENCE VOLTAGE GENERATION CIRCUIT

BACKGROUND OF THE INVENTION

1. Field of the Invention

The present invention relates to a reference voltage generation circuit, and more particularly relates to a reference voltage generation circuit that is still able to generate constant reference voltage and maintain a certain level of drive capability at the same time even when power supply voltage is relatively low.

2. Description of the Related Art

Reference voltage has been widely applied to electronic circuits, and plays a very important role in the electronic circuits; as a result, it would be desirable to provide a reference voltage generation circuit that is able to generate the reference voltage with high stability and has a certain level of drive capability at the same time.

FIG. 1 is a circuit diagram of a reference voltage generation circuit in conventional techniques. In the reference voltage generation circuit as shown in FIG. 1, VDDA refers to power supply voltage, and VREF refers to output voltage output from an output terminal of the reference voltage generation circuit. The basic principle of this reference voltage generation circuit is as follows.

A transistor ND1 refers to an N-channel depletion mode field effect transistor, and serves as an electric current source. When the transistor ND1 works in a saturation region, since the gate and the source of the transistor ND1 are connected to each other, drain current Id_ND1 flowing through the transistor ND1 is $Id_ND1=K_ND1\times(Vgs_ND1-Vth_ND1)^2$. Here Vgs_ND1 refers to voltage between the gate and the source of the transistor ND1; Vth_ND1 refers to threshold voltage of the transistor ND1; $K_ND1=0.5\times\mu n\times Cox\times W/L$. Here μn refers to carrier mobility; W refers to channel width of the transistor ND1; L refers to channel length of the transistor ND1; and Cox refers to gate oxide capacitance per unit area.

A transistor N1 refers to an N-channel enhancement mode field effect transistor. When the transistor N1 works in a saturation region, drain current Id_N1 flowing through the transistor N1 is $Id_N1=K_N1\times(Vgs_N1-Vth_N1)^2$. Here Vgs_N1 refers to voltage between the gate and the source of the transistor N1; Vth_N1 refers to threshold voltage of the transistor N1; $K_N1=0.5\times\mu n\times Cox\times W/L$. Here μn refers to carrier mobility; W refers to channel width of the transistor N1; L refers to channel length of the transistor N1; and Cox refers to gate oxide capacitance per unit area. Since the source of the transistor N1 is connected to ground, the voltage Vgs_N1 between the gate and the source of the transistor N1 is equal to gate voltage Vg_N1 of the transistor N1; as a result, the drain current Id_N1 flowing through the transistor N1 is $Id_N1=K_N1\times(Vg_N1-Vth_N1)^2$.

Transistors P1 and P2 form a current mirror circuit, so electric current flowing through the transistor P1 and electric current flowing through the transistor P2 are equal; in other words, the drain current Id_ND1 flowing through the transistor ND1 is equal to the drain current Id_N1 flowing through the transistor N1, i.e., $K_ND1\times(Vgs_ND1-Vth_ND1)^2=K_N1\times(Vg_N1-Vth_N1)^2$. As a result, $Vg_N1=[(K1/K2)\times(Vth_ND1)^2]^{1/2}+Vth_N1$. Therefore it is apparent that the gate voltage Vg_N1 of the transistor N1 is constant voltage that is not influenced by the power supply voltage VDDA of the reference voltage generation circuit.

The output voltage VREF output from the output terminal of the reference voltage generation circuit is input into the gate of the transistor N1 as negative feedback voltage. After being compared with the gate voltage Vg_N1 of the transistor N1, the output voltage VREF is output from the gate of the transistor N1 to the transistor N2. And after being driven by the transistor N2, the output voltage VREF is output from the source of the transistor N2 to the output terminal of the reference voltage generation circuit so that the output voltage VREF output from the output terminal of the reference voltage generation circuit is stabilized at the level of the gate voltage of the transistor N1; at the same time, drive current is output from the transistor N2 to the output terminal of the reference voltage generation circuit so that the reference voltage generation circuit has a certain level of drive capability.

An ideal reference voltage generation circuit should be able to generate constant reference voltage and maintain a certain level of drive capability at the same time without receiving influence from power supply voltage. However, in the reference voltage generation circuit shown in FIG. 1, the output voltage VREF output from the output terminal of the reference voltage generation circuit may be influenced by open loop gain of the reference voltage generation circuit, i.e., $VREF=Vg_N1/(1+1/Av)$. Here Av refers to the open loop gain of the reference voltage generation circuit, and is composed of two parts: $Av1\approx gm_N1\times(gm_P4+gmb_P4)\times r0_P4\times r0_P2$ and $Av2\approx gm_N2/((Iout/VREF)+gm_N2)$; that is, $Av=Av1\times Av2$. Here gm_N1 refers to transconductance of the transistor N1; gm_P4 refers to transconductance of transistor P4; gmb_P4 refers to body effect transconductance of the transistor P4; r0_P4 refers to equivalent resistance of the transistor P4; r0_P2 refers to equivalent resistance of the transistor P2; gm_N2 refers to transconductance of the transistor N2; Iout refers to drive current output from the output terminal of the reference voltage generation circuit; and VREF refers to the output voltage output from the output terminal of the reference voltage generation circuit. Since $Av2\approx1$, $Av\approx Av1$, i.e., $Av\approx gm_N1\times(gm_P4+gmb_P4)\times r0_P4\times r0_P2$. In an ideal circumstance, the open loop gain of the reference voltage generation circuit approaches infinity; as a result, the output voltage VREF output from the output terminal of the reference voltage generation circuit is able to be stabilized at the level of the gate voltage of the transistor N1. However, when the power supply voltage drops to a relatively low value, in a case where the drive current output from the transistor N2 to the output terminal of the reference voltage generation circuit is maintained without change, the gate voltage of the transistor N2 is maintained without change too; as a result, voltage between the power supply voltage and the gate of the transistor N2 drops because the power supply voltage drops. That is, voltage between the source and the drain of the transistors P2 and P4 drops so that the transistors P2 and P4 enter a linear region from the saturation region. After the transistors P2 and P4 enter the linear region from the saturation region, the transconductance and the equivalent resistance of the transistors P2 and P4 become small so that the open loop gain Av of the reference voltage generation circuit apparently drops; as a result, the output voltage VREF output from the output terminal of the reference voltage generation circuit drops. Therefore it is apparent that when the power supply voltage drops to a relatively low value, the above-mentioned conventional reference voltage generation circuit shown in FIG. 1 is not able to generate constant reference voltage and maintain a certain level of drive capability at the same time.

SUMMARY OF THE INVENTION

In order to overcome the disadvantages of the prior art, the present invention provides a reference voltage generation circuit that is still able to generate constant reference voltage and maintain a certain level of drive capability even when power supply voltage is relatively low.

A reference voltage generation circuit according to an embodiment of the present invention comprises a reference voltage generation and comparison unit and a drive unit, wherein, the reference voltage generation and comparison unit generates a reference voltage; an output terminal of the reference voltage generation and comparison unit is connected to the drive unit; an output voltage output from an output terminal of the reference voltage generation circuit is input into the reference voltage generation and comparison unit as a negative feedback voltage; after being compared with the reference voltage generated by the reference voltage generation and comparison unit, the output voltage is output from the output terminal of the reference voltage generation and comparison unit to the drive unit; when a power supply voltage of the reference voltage generation circuit is greater than a first turn-on voltage, after being driven by the drive unit, the output voltage is output from an output terminal of the drive unit to the output terminal of the reference voltage generation circuit so that the output voltage output from the output terminal of the reference generation circuit is stabilized at a level of the reference voltage generated by the reference voltage generation and comparison unit. The reference voltage generation circuit further comprises M drive unit candidate circuits connected to the output terminal of the reference voltage generation and comparison unit, wherein, the first drive unit candidate circuit to the M-th drive unit candidate circuit correspond to the first turn-on voltage to an M-th turn-on voltage; the first turn-on voltage to the M-th turn-on voltage are gradually stepped down in series; the N-th drive unit candidate circuit is turned on to work when the power supply voltage of the reference voltage generation circuit is less than the N-th turn-on voltage. The output voltage output from the output terminal of the reference voltage generation circuit is input into the reference voltage generation and comparison unit as a negative feedback voltage; after being compared with the reference voltage generated by the reference voltage generation and comparison unit, the output voltage is output from the output terminal of the reference voltage generation and comparison unit to the M drive unit candidate circuits; when the power supply voltage of the reference voltage generation circuit is less than the N-th turn-on voltage, after being driven by at least the N-th drive unit candidate circuit, the output voltage is output from at least the N-th drive unit candidate circuit to the output terminal of the reference voltage generation circuit. Here M is an integer number greater than or equal to 1, and N is an integer number greater than or equal to 1 and less than or equal to M.

The reference voltage generation circuit according to the embodiment of the present invention comprises plural drive unit candidate circuits having various working properties; as a result, based on different values of the power supply voltage, the drive unit candidate circuits whose working properties correspond to the values of the power supply voltage work. However, in the conventional technique, no matter what values the power supply voltage has, only one drive unit works. Therefore, even when the power supply voltage drops to a relatively low value, the reference voltage generation circuit according to the embodiment of the present invention still can generate constant reference voltage and maintain a certain level of drive capability.

DETAILED DESCRIPTION OF THE PREFERRED EMBODIMENTS

Hereinafter, various embodiments of the present invention will be concretely described with reference to the drawings. Here it should be noted that the same symbols, which are in the specification and the drawings, stand for constructional elements having the same or basically-same function and structure, and repeated explanations for the constructional elements are omitted in the specification.

Figure 2:
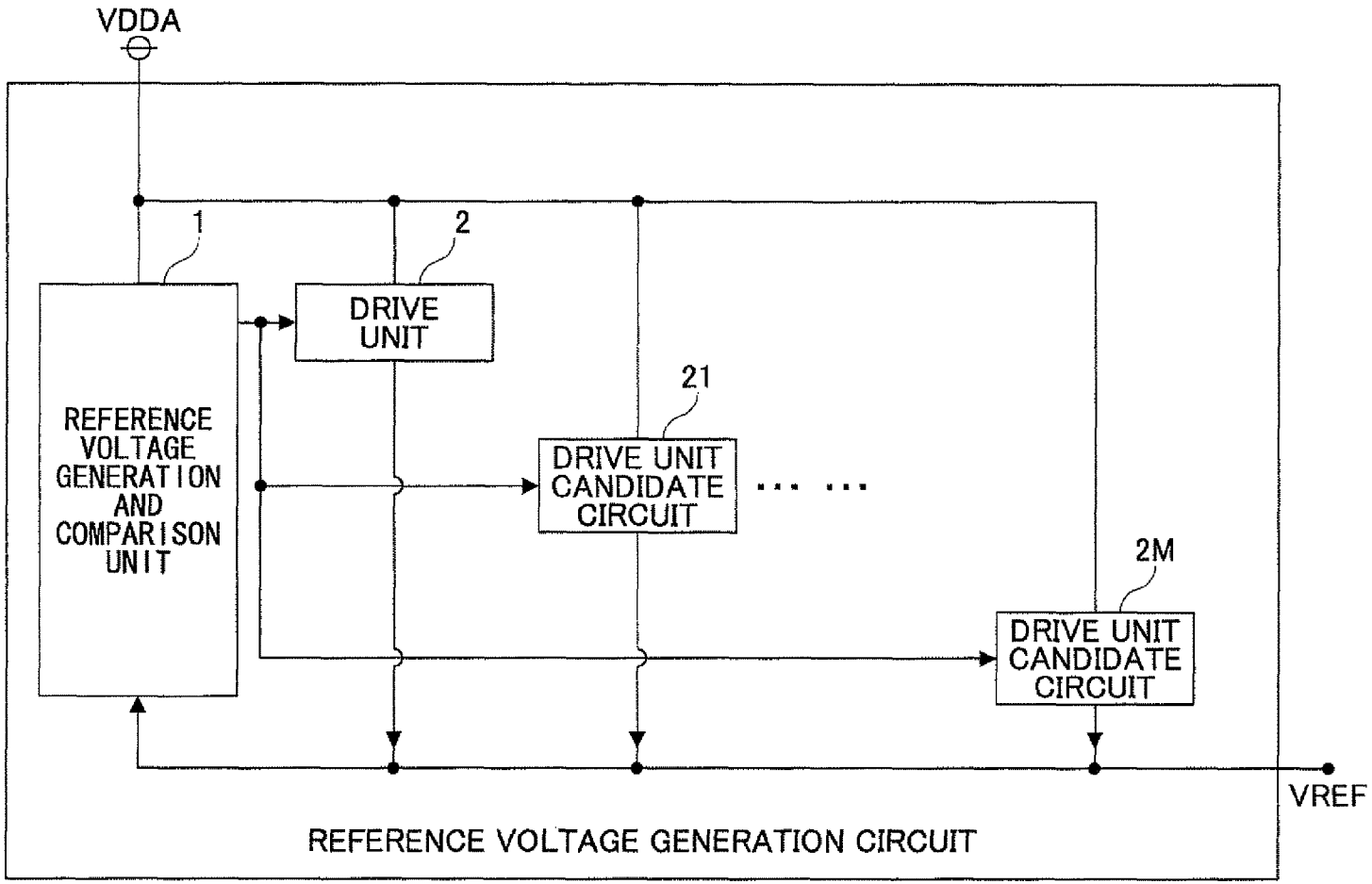
FIG. 2 is a block diagram of a reference voltage generation circuit according to an embodiment of the present invention.

FIG. 2 is a block diagram of a reference voltage generation circuit according to an embodiment of the present invention. As shown in FIG. 2, the reference voltage generation circuit comprises a reference voltage generation and comparison unit 1, a drive unit 2, and M drive unit candidate circuits 21~2M; here M is an integer number greater than or equal to 1.

The reference voltage generation and comparison unit 1 generates reference voltage. An output terminal of the reference voltage generation and comparison unit 1 is connected to the drive unit 2 and the M drive unit candidate circuits 21~2M. An output terminal of the drive unit 2 is connected to an output terminal of a reference voltage generation circuit. Output voltage output from the output terminal of the reference voltage generation circuit is input into the reference voltage generation and comparison unit 1 as negative feedback voltage. After being compared with the reference voltage generated by the reference voltage generation and comparison unit 1, the output voltage is output from the output terminal of the reference voltage generation and comparison unit 1 to the drive unit 2. When power supply voltage of the reference voltage generation circuit is greater than first turn-on voltage, after being driven by the drive unit 2, the output voltage is output from the output terminal of the drive unit 2 to the output terminal of the reference voltage generation circuit so that the output voltage is able to be stabilized at the level of the reference voltage generated by the reference voltage generation and comparison unit 1.

The first drive unit candidate circuit 21 to the M-th drive unit candidate circuit 2M correspond to the first turn-on voltage to M-th turn-on voltage, and values of the first turn-on voltage to the M-th turn-on voltage are gradually stepped down in series. The N-th drive unit candidate circuit is turned on to work when the power supply voltage of the reference voltage generation circuit is less than the N-th turn-on voltage; here N is an integer number greater than or equal to 1 and less than or equal to M.

The output voltage output from the output terminal of the reference voltage generation circuit is input into the reference voltage generation and comparison unit 1 as a negative voltage; after being compared with the reference voltage generated by the reference voltage generation and comparison unit 1, the output voltage is output from the output terminal of the reference voltage generation and comparison unit 1 to the M drive unit candidate circuits 21~2M. When the power supply voltage of the reference voltage generation circuit is less than the N-th turn-on voltage, the output voltage is driven by at least the N-th drive unit candidate circuit, and then is output at least from the output terminal of the N-th drive unit candidate circuit to the output terminal of the reference voltage generation circuit; as a result, the output voltage is stabilized at the level of the reference voltage generated by the reference voltage generation and comparison unit 1.

Figure 3:
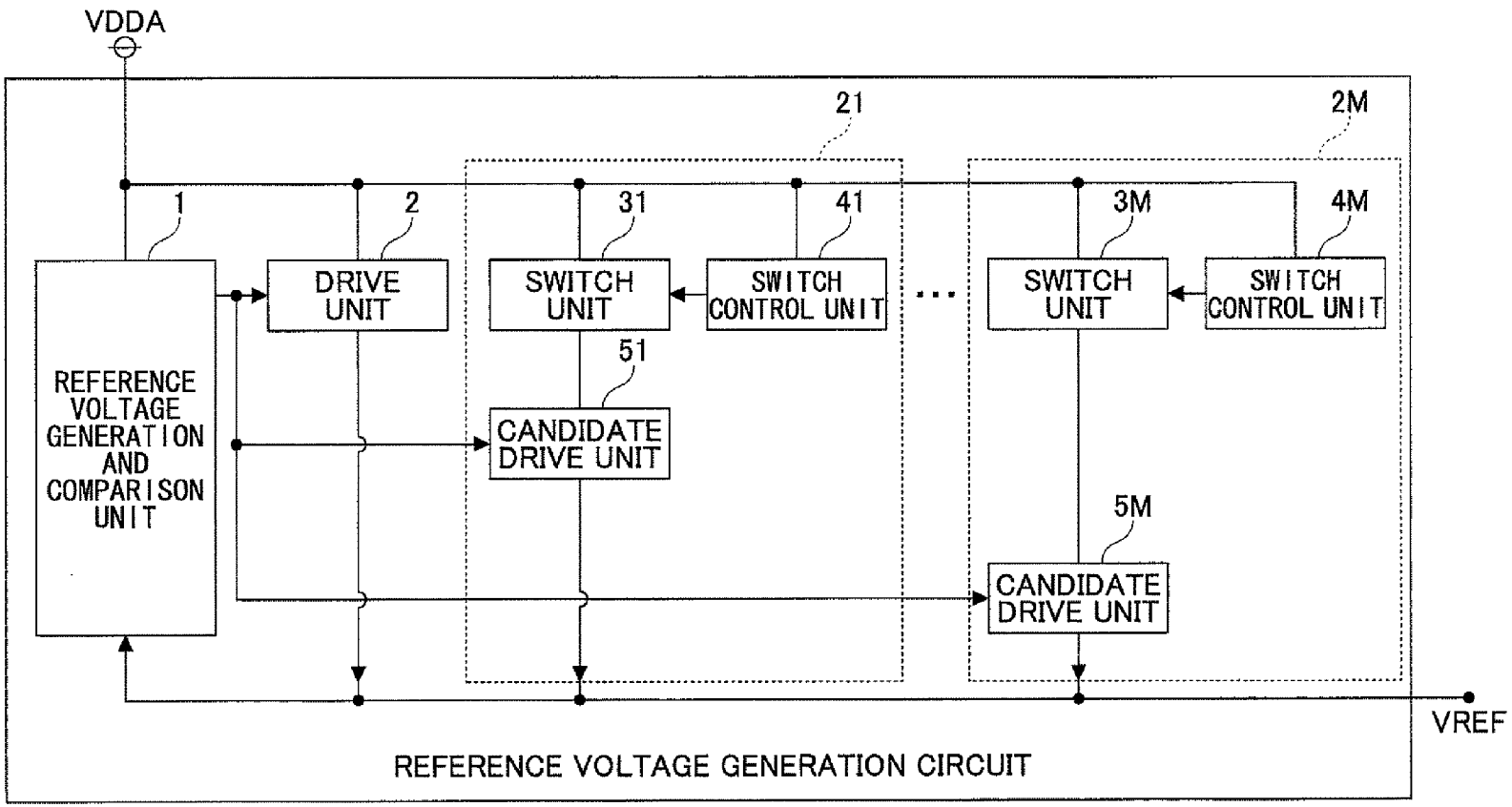
FIG. 3 is a block diagram of concrete structures of drive unit candidate circuits in a reference voltage generation circuit according to an embodiment of the present invention and relationships between drive unit candidate circuits and other units.

FIG. 3 is a block diagram of concrete structures of the drive unit candidate circuits 21~2M in the reference voltage generation circuit according to an embodiment of the present invention and relationships between the drive unit candidate circuits 21~2M and other units. As shown in FIG. 3, each of the drive unit candidate circuits 21~2M includes a candidate drive unit, a switch unit, and a switch control unit. For example, as for the drive unit candidate circuit 21, an input terminal of the switch unit 31 is connected to the power supply voltage VDDA of the reference voltage generation circuit; an output terminal of the switch control unit 41 is connected to another input terminal of the switch unit 31; an output terminal of the switch unit 31 is connected to a power input terminal of the candidate drive unit 51; the output terminal of the reference voltage generation and comparison unit 1 is connected to a control terminal of the candidate drive unit 51; and an output terminal of the candidate drive unit 51 is connected to the output terminal of the reference voltage generation circuit.

When the power supply voltage of the reference voltage generation circuit is less than the N-th turn-on voltage, at least in the N-th drive unit candidate circuit, control voltage is output from the output terminal of the switch unit 4M to the switch unit 3M so as to control the switch unit 3M to connect the candidate drive unit 5M to the power supply voltage of the reference voltage generation circuit; as a result, the candidate drive unit 5M is turned on and starts working.

In what follows, the embodiments of the present invention will be concretely illustrated with reference to the drawings.

Figure 4:
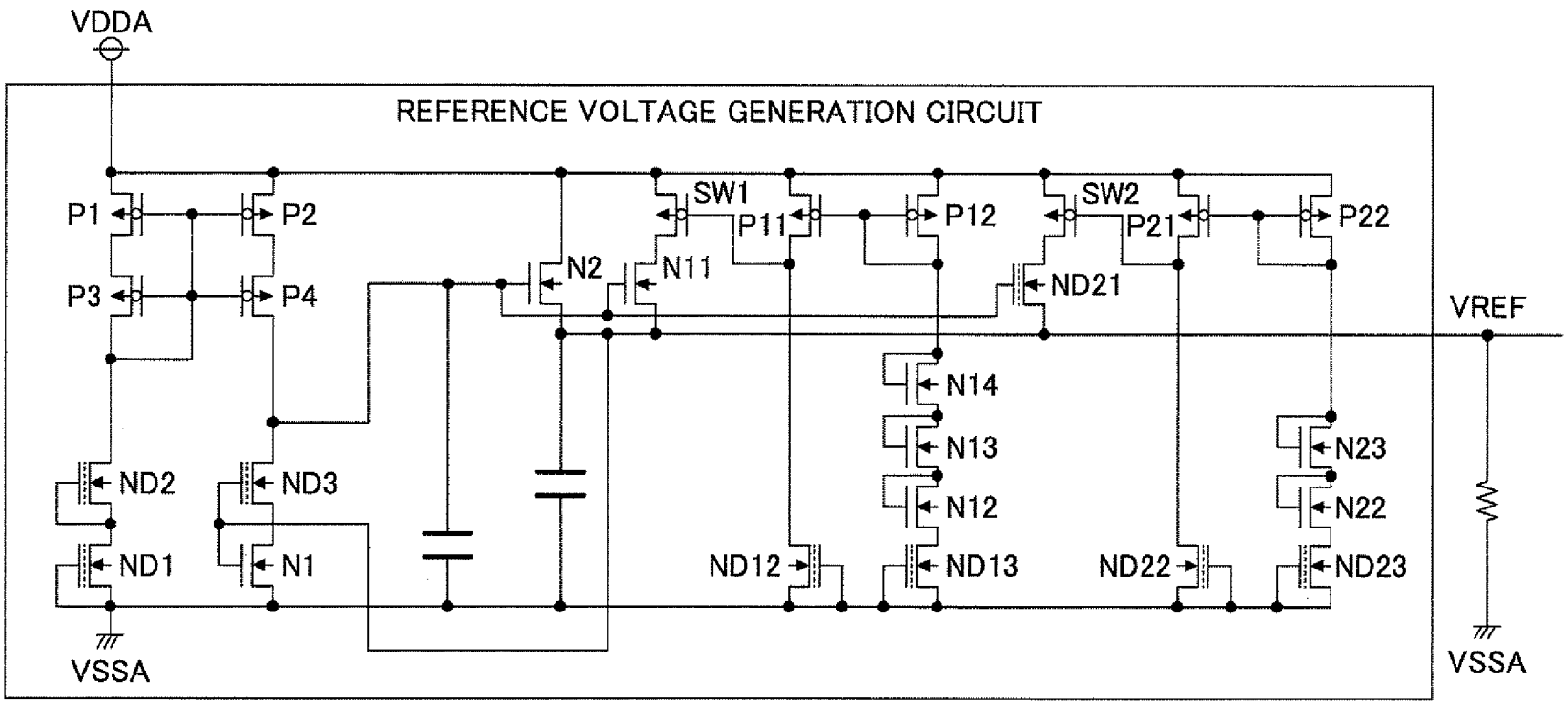
FIG. 4 is a circuit diagram of a reference voltage generation circuit according to a first embodiment of the present invention.

FIG. 4 is a circuit diagram of a reference voltage generation circuit according to a first embodiment of the present invention. As shown in FIG. 4, in the first embodiment of the present invention, the reference voltage generation and comparison unit 1 includes P-channel field effect transistors P1, P2, P3, and P4, N-channel depletion mode field effect transistors ND1, ND2, and ND3, and an N-channel enhancement mode field effect transistor N1; the drive unit 2 includes an N-channel enhancement mode field effect transistor N2 having relatively low threshold voltage. The circuit structures of the reference voltage generation and comparison unit 1 and the drive unit 2 are the same as those shown in the conventional technique (i.e. FIG. 1); the improvement of the embodiment of the present invention is the design of drive unit candidate circuits. The structures and the working principle of the drive unit candidate circuits are concretely described as follows.

In the first drive unit candidate circuit, a candidate drive unit is composed of a transistor N11 which is an N-channel enhancement mode field effect transistor; a switch unit is composed of a transistor SW1 which is a P-channel field effect transistor; a switch control unit is composed of transistors P11, P12, ND12, N12, ND13, N13, and N14 in which the transistors P11 and P12 are P-channel field effect transistors, the transistors ND12 and ND13 are N-channel depletion mode field effect transistors, and the transistors N12, N13, and N14 are N-channel enhancement mode field effect transistors.

In the switch control unit, the transistors P11 and P12 form a current mirror circuit; the transistors ND12 and ND13 form a voltage pull-down circuit; and the transistors N12, N13, and N14 form a turn-on voltage control circuit.

Two input terminals of the current mirror circuit are connected to a power supply voltage VDDA of the reference voltage generation circuit; one output terminal of the current mirror circuit is connected to one input terminal of the voltage pull-down circuit and serves as an output terminal of the switch control unit, and another output terminal of the current mirror circuit is connected to another input terminal of the voltage pull-down circuit via the turn-on voltage control circuit.

In particular, in the current mirror circuit composed of the transistors P11 and P12, the sources of the transistors P11 and P12 are connected to the power supply voltage VDDA of the reference voltage generation circuit, and the gates of the transistors P11 and P12 are connected to each other and are connected to the drain of the transistor P12. In the turn-on voltage control circuit composed of the transistors N12, N13, and N14, the corresponding gates and drains of the adjacent transistors N12, N13, and N14 are connected to each other; the source of the transistor N12 is connected to the drain of the transistor ND13 in the voltage pull-down circuit; the drain of the transistor N12 is connected to the source of the transistor N13; the drain of the transistor N13 is connected to the source of the transistor N14; and the drain of the transistor N14 is connected to the drain of the transistor P12 in the current mirror circuit. In the voltage pull-down circuit composed of the transistors ND12 and ND13, the source and the gate of the transistor ND12 are connected to ground; the drain of the transistor ND12 is connected to the drain of the transistor P11 in the current mirror circuit and serves as the output terminal of the switch control unit; and the source and the gate of the transistor ND13 are connected to ground.

The output terminal of the switch control unit is connected to the gate of the transistor SW1 forming the switch unit; the source of the transistor SW1 is connected to the power supply voltage VDDA of the reference voltage generation circuit; and the drain of the transistor SW1 is connected to the drain of the transistor N11 forming the candidate drive unit. The gate of the transistor N11 is connected to the output terminal of the reference voltage generation and comparison unit 1, i.e., the drain of the transistor ND3. The source of the transistor N11 is connected to the output terminal of the reference generation circuit.

The first drive unit candidate circuit corresponds to a turn-on voltage by which the transistor N1 serving as the candidate drive unit is able to be turned on, and the turn-on voltage of the first drive unit candidate circuit is equal to the sum of threshold voltages of the transistors N12, N13, and N14 forming the turn-on voltage control circuit and the transistor P12 forming the current mirror circuit.

The structure of the second drive unit candidate circuit is similar to that of the first drive unit candidate circuit; the second drive unit candidate circuit also corresponds to a turn-on voltage by which an N-channel depletion mode field effect transistor ND21 serving as a candidate drive unit is able to be turned on. The turn-on voltage of the second drive unit candidate circuit is equal to the sum of threshold voltages of transistors N22 and N23 forming a turn-on voltage control circuit and a transistor P22 forming a current mirror circuit.

The only difference between the first drive unit candidate circuit and the second drive unit candidate is that the turn-on voltage of the second drive unit candidate circuit is less than that of the first drive unit candidate circuit, and threshold voltage of the transistor ND21 forming the candidate drive unit in the second drive unit candidate circuit is less than that of the transistor N11 forming the candidate drive unit in the first drive unit candidate circuit.

In the first embodiment, the working principles of the first drive unit candidate circuit and the second drive unit candidate circuit are almost the same; here the working processes of these two drive unit candidate circuits are described as follows.

In the first drive unit candidate circuit, electric current supplied by the transistor ND12 serving as an electric current source is 0.1 μA, and electric current supplied by the transistor ND13 serving as an electric current source is 1 μA. Since when the power supply voltage VDDA of the reference voltage generation circuit is less than the turn-on voltage of the first drive unit candidate circuit, i.e., since when the power supply voltage VDDA is less than the sum of the threshold voltages of transistors N12, N13, and N14 and the transistor P12, the transistors N12, N13, and N14 and the transistor P12 are turned off; as a result, there is no electric current flowing through the transistors N12, N13, and N14 and the transistor P12. Furthermore since the transistors P11 and P12 form the current mirror circuit, there is also no electric current following through the transistor P11. Therefore control voltage is output from the drain of the transistor ND12 serving as the electric source to the gate of the transistor SW1; due to the control voltage, the transistor SW1 is turned on. Since the transistor SW1 is turned on, the transistor N11 serving as the candidate drive unit is connected to the power supply voltage VDDA of the reference voltage generation circuit so that the transistor N11 is turned on and starts working.

In a case where the transistor N11 is turned on, the output voltage output from the output terminal of the reference voltage generation circuit is input into the reference generation and comparison unit 1 as negative feedback voltage. After being compared with the reference voltage generated by the reference voltage generation and comparison unit 1, the output voltage output from the output terminal of the reference voltage generation circuit is output from the output terminal of the reference voltage generation and comparison unit 1, i.e., the drain of the transistor ND3, to the transistor N11. And after being driven by the transistor N11, the output voltage is output from the source of the transistor N11 to the output terminal of the reference voltage generation circuit.

In the second drive unit candidate circuit, the working principle of being turned on of the transistor ND21 serving as the candidate drive unit is the same as that of the transistor N11, i.e., when the power supply voltage VDDA of the reference voltage generation circuit is less than the turn-on voltage of the second drive unit candidate circuit, the transistor ND21 is turned on and starts working.

In a case where the transistor ND21 is turned on to work, the output voltage output from the output terminal of the reference voltage generation circuit is input to the reference voltage generation and comparison unit 1 as negative feedback voltage, then is output to the transistor ND21 from the output terminal of the reference voltage generation and comparison unit 1, i.e., the drain of the transistor ND3 after being compared with the reference voltage generated by the reference voltage generation and comparison unit 1, and then is output to the output terminal of the reference voltage generation circuit from the source of the transistor ND21 after being driven by the transistor ND21.

Since the turn-on voltage of the second drive unit candidate circuit is less than the turn-on voltage of the first drive unit candidate circuit, when the power supply voltage VDDA of the reference voltage generation circuit is less than the turn-on voltage of the second drive unit candidate circuit, both the transistor ND21 and the transistor N11 are turned on to work.

In the first embodiment, although an electric current source circuit formed of the transistors ND12 and ND13 is adopted to serve as the voltage pull-down circuit in the switch control unit, this kind of formation of the voltage pull-down circuit is just for purpose of illustration, i.e., is not for limiting the present invention. In an embodiment of the present invention, an electric current source circuit, a mirror electric current source circuit generated by an electric current source circuit, an pull-down resistor, or an other device able to realize the same function may be adopted to form the voltage pull-down circuit.

In the first embodiment, although the numbers of the transistors forming the turn-on voltage control circuits in the first drive unit candidate circuit and the second drive unit candidate circuit are different, the numbers of the transistors are just for purposes of illustration, i.e., are not for limiting the present invention. In an embodiment of the present invention, the numbers of the transistors may be the same; in other words, as long as the transistors forming the turn-on voltage control circuits in the first drive unit candidate circuit and the second drive unit candidate circuit are able to let the turn-on voltages of the drive unit candidate circuits be different, they are good.

In the first embodiment, although the reference voltage generation circuit only includes two drive unit candidate circuits, the number of the drive unit candidate circuits is just for purpose of illustration, i.e., is not for limiting the present invention. In an embodiment of the present invention, the reference voltage generation circuit may include M drive unit candidate circuits connected to the output terminal of the reference voltage generation and comparison unit 1 (here M is an integer number greater than 1); the first drive unit candidate circuit to the M-th drive unit candidate circuit correspond to a first turn-on voltage to an M-th turn-on voltage; values of the first turn-on voltage to the M-th turn-on voltage are gradually stepped down in series; each of the drive unit candidate circuits is turned on to work when the power supply voltage VDDA of the reference voltage generation circuit is less than the turn-on voltage of the corresponding drive unit candidate voltage; with regard to the first drive unit candidate circuit to the M-th drive unit candidate circuit, values of threshold voltages of transistors forming the candidate drive units of the respective drive unit candidate circuits are gradually stepped down in series, and the value of the threshold voltage of the transistor N2 forming the drive unit 2 is greater than that of the threshold voltage of the transistor forming the first candidate drive unit.

Figure 5:
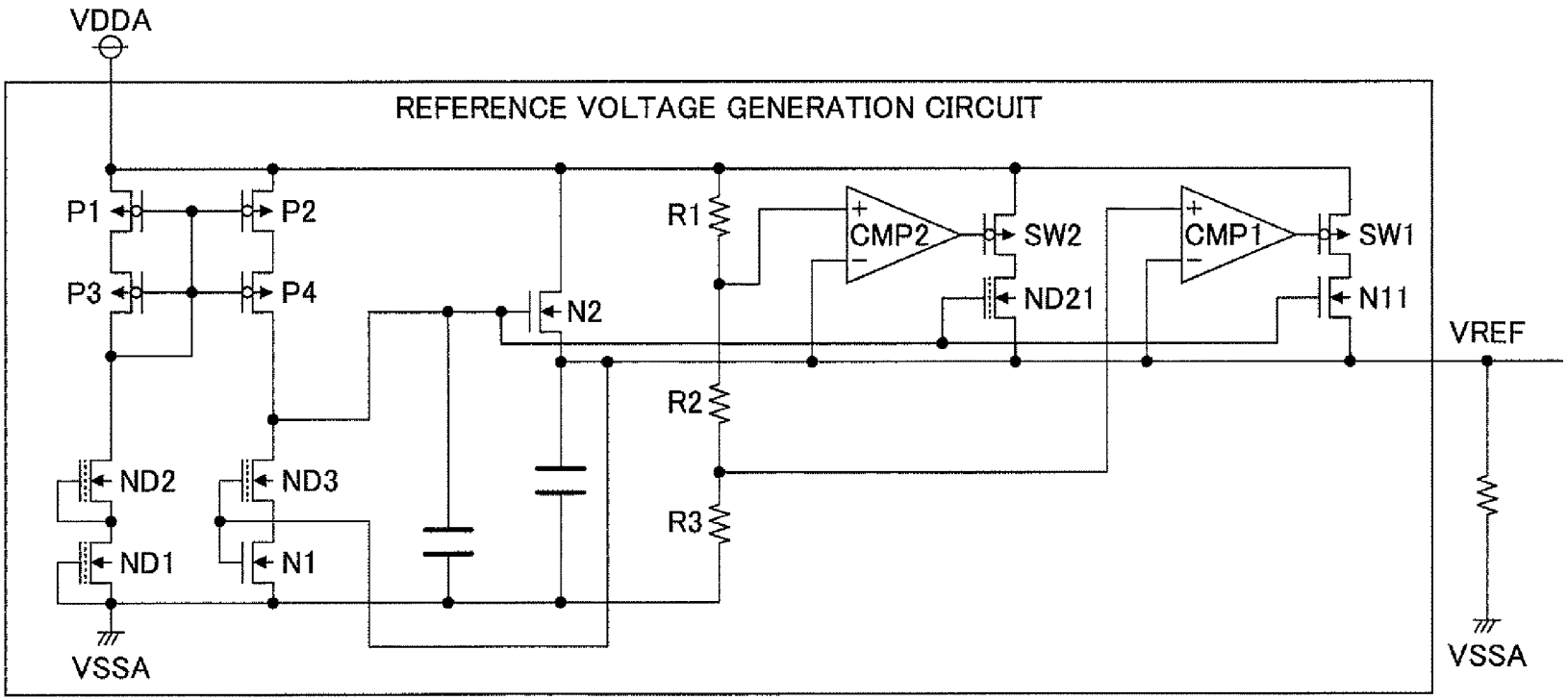
FIG. 5 is a circuit diagram of a reference voltage generation circuit according to a second embodiment of the present invention.

FIG. 5 is a circuit diagram of a reference voltage generation circuit according to a second embodiment of the present invention. As shown in FIG. 5, in the second embodiment according to the present invention, the circuit structures of a reference voltage generation and comparison unit 1 and a drive unit 2 are the same as those in the first embodiment shown in FIG. 4. As a result, in what follows, only the differences between the first embodiment and the second embodiment are concretely described.

As shown in FIG. 5, there are two drive unit candidate circuits in the second embodiment of the present invention. In the first drive unit candidate circuit, a candidate drive unit is formed of a transistor N11 which is an N-channel enhancement mode field effect transistor; a switch unit is formed of a transistor SW1 which is a P-channel field effect transistor; and a switch control unit is formed of a comparator CMP1.

In the second drive unit candidate circuit, a candidate drive unit is formed of a transistor ND21 which is an N-channel depletion mode field effect transistor; a switch unit is formed of a transistor SW2 which is a P-channel field effect transistor; and a switch control unit is formed of a comparator CMP2.

There is a voltage-dividing circuit formed of resistors R1, R2, and R3 connected in series between a power supply voltage VDDA of the reference voltage generation circuit and ground; the voltage-dividing circuit has two voltage-dividing output terminals (i.e., the number of the voltage-dividing output terminals is the same with that of the drive unit candidate circuits) in which a first voltage-dividing output terminal is between the resistors R2 and R3, and a second voltage-dividing output terminal is between the resistors R1 and R2; voltage output from the first voltage-dividing output terminal is less than that output from the second voltage-dividing output terminal.

One input terminal of the comparator CMP1 forming the switch control unit in the first drive unit candidate circuit is connected to the first voltage-dividing output terminal; another input terminal of the comparator CMP1 is connected to an output terminal of the reference voltage generation circuit; an output terminal of the comparator CMP1 is connected to the gate of the transistor SW1 forming the switch unit. The source of the transistor SW1 is connected to the power supply voltage VDDA of the reference voltage generation circuit, and the drain of the transistor SW1 is connected to the drain of the transistor N11 forming the candidate drive unit. The gate of the transistor N11 is connected to an output terminal of a reference voltage generation and comparison unit 1, i.e., the drain of a transistor ND3. The source of the transistor N11 is connected to the output terminal of the reference voltage generation circuit.

One input terminal of the comparator CMP2 forming the switch control unit in the second drive unit candidate circuit is connected to the second voltage-dividing output terminal; another input terminal of the comparator CMP2 is connected to the output terminal of the reference voltage generation circuit; an output terminal of the comparator CMP2 is connected to the gate of the transistor SW2 forming the switch unit. Connections of the transistor SW2 forming the switch unit and the transistor ND21 forming the candidate drive unit in the second drive unit candidate circuit are the same as those in the first drive unit candidate circuit.

The comparator CMP1 compares voltage output from the first voltage-dividing output terminal and voltage output from the output terminal of the reference voltage generation circuit; if the voltage output from the first voltage-dividing output terminal is less than the voltage output from the output terminal of the reference voltage generation circuit, then the comparator CMP1 outputs control voltage to let the transistor SW1 be turned on. Since the transistor SW1 is turned on, the transistor N11 serving as the candidate drive unit is connected to the power supply voltage VDDA of the reference voltage generation circuit; as a result, the transistor N11 is turned on to work.

In a case where the transistor N11 is turned on to work, the output voltage output from the output terminal of the reference voltage generation circuit is input to the reference voltage generation and comparison unit 1 as negative feedback voltage, then is output to the transistor N11 from the output terminal of the reference voltage generation and comparison unit 1, i.e., the drain of the transistor ND3 after being compared with the reference voltage generated by the reference voltage generation and comparison unit 1, and then is output to the output terminal of the reference voltage generation circuit from the source of the transistor N11 after being driven by the transistor N11.

In the second drive unit candidate circuit, the principle of turning on the transistor ND21 serving as the candidate drive unit is the same as that of turning on the transistor N11, i.e., if voltage output from the second voltage-dividing output terminal is less than the output voltage output from the output terminal of the reference voltage generation circuit, then the transistor ND21 is turned on to work.

In a case where the transistor ND21 is turned on to work, the output voltage output from the output terminal of the reference voltage generation circuit is input to the reference voltage generation and comparison unit 1 as negative feedback voltage, then is output to the transistor ND21 from the output terminal of the reference voltage generation and comparison unit 1, i.e., the drain of the transistor ND3 after being compared with the reference voltage generated by the reference voltage generation and comparison unit 1, and then is output to the output terminal of the reference voltage generation circuit from the source of the transistor ND21 after being driven by the transistor ND21.

Since the voltage output from the first voltage-dividing output terminal is less than the voltage output from the second voltage-dividing output terminal, if the voltage output from the second voltage-dividing output terminal is less than the output voltage output from the output terminal of the reference voltage generation circuit, then the voltage output from the first voltage-dividing output terminal is also less than the output voltage output from the output terminal of the reference voltage generation circuit; in this case, both the transistor ND21 and the transistor N11 are turned on to work.

In the second embodiment, although the reference voltage generation circuit only includes two drive unit candidate circuits, the number of the drive unit candidate circuits is just for purpose of illustration, i.e., is not for limiting the present invention. In an embodiment of the present invention, the reference voltage generation circuit may include M drive unit candidate circuits connected to the output terminal of the reference voltage generation and comparison unit 1 (here M is an integer number greater than 1); with regard to the switch control units of the first drive unit candidate circuit to the M-th drive unit candidate circuit, first input terminals of the switch control units are sequentially connected to corresponding gradually-stepping-up voltage-dividing output terminals, and second input terminals of the switch control units are connected to the output terminal of the reference voltage generation circuit; then each of the switch control units compares the voltages input from its two input terminals, and then outputs control voltage from its output terminal to the switch unit; with regard to the first drive unit candidate circuit to the M-th drive unit candidate circuit, values of threshold voltages of transistors forming the candidate drive units of the respective drive unit candidate circuits are gradually stepped down in series, and the value of the threshold voltage of the transistor N2 forming the drive unit 2 is greater than that of the threshold voltage of the transistor forming the first candidate drive unit.

In the second embodiment, with regard to each of the drive unit candidate circuits, although one input terminal of the comparator forming the switch control unit is connected to one voltage-dividing output terminal, and another input terminal of the comparator is connected to the output terminal of the reference voltage generation circuit, the connection of the other input terminal of the comparator is just for purpose of illustration, i.e., is not for limiting the present invention. In an embodiment of the present invention, the other input terminal of the comparator forming the switch control unit in each of the drive unit candidate circuits may also be connected to another reference voltage. In other word, as long as the reference voltage to which the other input terminal of the comparator forming the switch control unit in each of the drive unit candidate circuits is equal to the product of turn-on voltage of the drive unit candidate circuit and voltage-dividing coefficient of the voltage-dividing output terminal connecting to one input terminal of the comparator forming the switch control unit in the drive unit candidate circuit, it is good; here the voltage-dividing coefficient of each of the voltage-dividing output terminals is equal to the rate of voltage output from the voltage-dividing output terminal to the power supply voltage.

It is apparent according to the above embodiments that the reference voltage generation circuit in the embodiments includes plural drive unit candidate circuits having different working properties; based on different values of the power supply voltage, the drive unit candidate circuits whose working properties correspond to the values of the power supply voltage work are selected. In particular, as the power supply voltage VDDA gradually steps down, the reference voltage generation circuit selects transistors whose threshold voltages gradually step down as the drive units. In general, in a case where the transistors output the same drive current, the gate voltage of the transistor having low threshold voltage is low. As a result, when the power supply voltage drops to a relatively low value, in a case where the drive current output from the transistor to the output terminal of the reference voltage generation circuit is maintained to be unchangeable, since the gate voltage of the transistor drops too, voltage between the source and the drain of the transistors P2 and P4 cannot drop as the power supply voltage drops so that it is ensured that the open loop gain of the reference voltage generation circuit cannot drop. Consequently, even when the power supply voltage drops, the output voltage VREF output from the output terminal of the reference voltage generation circuit can still be stabilized at the level of the gate voltage of the transistor N1.

Figure 1:
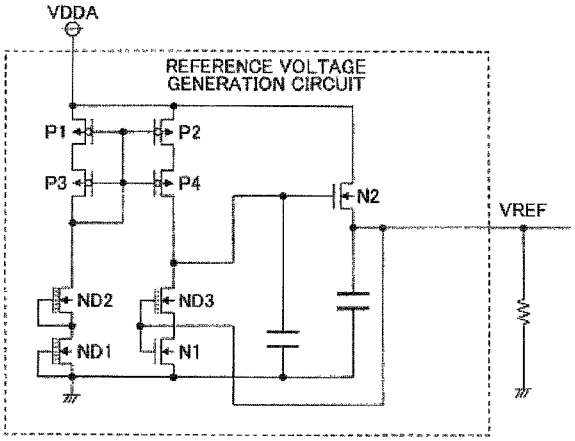
FIG.1 Prior Art
FIG. 1 is a circuit diagram of a reference voltage generation circuit in conventional techniques.
Figure 6:
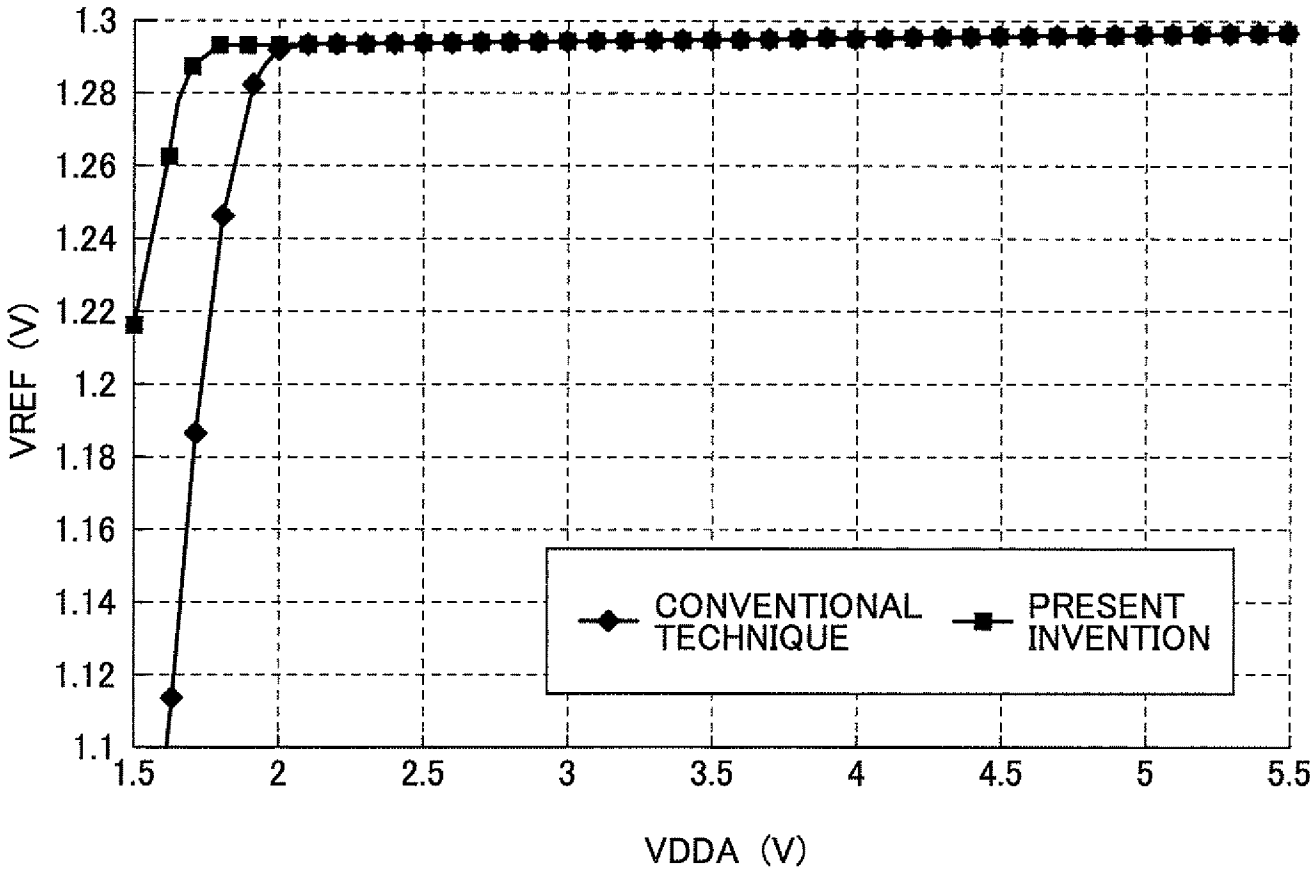
FIG. 6 illustrates curves of output voltages and power supply voltages according to an embodiment of the present invention and the conventional technique shown in FIG. 1.

FIG. 6 illustrates curves of output voltages and power supply voltages according to an embodiment of the present invention and the conventional technique shown in FIG. 1. It is apparent according to FIG. 6 that even if the power supply voltage VDDA drops to below 2 V, the reference voltage generation circuit in the embodiment of the present invention can still output a very constant reference voltage VREF.

The following Table 1 shows a comparison result of direct current open loop gains according to the embodiment of the present invention and the conventional technique shown in FIG. 1 when the power supply voltages drop.

TABLE 1

| POWER SUPPLY VOLTAGE (V) | DIRECT CURRENT OPEN LOOP GAIN (dB) IN CONVENTIONAL TECHNIQUE | DIRECT CURRENT OPEN LOOP GAIN (dB) IN EMBODIMENT OF PRESENT INVENTION |
|---|---|---|
| 2.0 | 31 | 66.22 |
| 1.9 | 10.94 | 60.27 |
| 1.8 | −0.3426 | 41.61 |
| 1.7 | −7.329 | 14.98 |

The following Table 2 shows a comparison result of linear modulations according to the embodiment of the present invention and the conventional technique shown in FIG. 1 when the power supply voltages drop.

TABLE 2

| POWER SUPPLY VOLTAGE (V) | LINEAR MODULATION (%) IN CONVENTIONAL TECHNIQUE | LINEAR MODULATION (%) IN EMBODIMENT OF PRESENT INVENTION |
|---|---|---|
| 2.0-5.5 | 0.076 | 0.037 |
| 1.9-5.5 | 0.38 | 0.043 |
| 1.8-5.5 | 1.34 | 0.059 |
| 1.7-5.5 | 2.88 | 0.22 |
| 1.6-5.5 | 4.68 | 0.85 |
| 1.5-5.5 | 6.57 | 2.01 |

The following Table 3 shows a comparison result of current ripple rejection ratios according to the embodiment of the present invention and the conventional technique shown in FIG. 1 when the power supply voltages drop.

TABLE 3

| POWER SUPPLY VOLTAGE (V) | CURRENT RIPPLE REJECTION RATIO (dB) IN CONVENTIONAL TECHNIQUE | CURRENT RIPPLE REJECTION RATIO (dB) IN EMBODIMENT OF PRESENT TECHNIQUE INVENTION |
|---|---|---|
| 2.0 | 31 | 51.6 |
| 1.9 | 13.3 | 49.1 |
| 1.8 | 6.1 | 40.1 |
| 1.7 | 3.4 | 18.2 |

It is apparent according to Tables 1-3 that compared to the conventional technique shown in FIG. 1, when the power supply voltage drops, the reference voltage generation circuit in the embodiment of the present invention is improved in aspects of the direct current open loop gain, the linear modulation, and the current ripple rejection ratio.

In the first and second embodiments of the present invention, although the switch unit is disposed between the power supply voltage VDDA and the candidate drive unit in each of the drive unit candidate circuits, it is possible to dispose the candidate drive unit between the power supply voltage VDDA and the switch unit; in this case, concrete connection of the candidate drive unit, the switch unit, and the switch control unit is as follows: the power supply input terminal of the candidate drive unit is connected to the power supply voltage VDDA of the reference voltage generation circuit, the output terminal of the reference voltage generation and comparison unit is connected to the control terminal of the candidate drive unit, the output terminal of the candidate drive unit is connected to one input terminal of the switch unit, the output terminal of the switch control unit is connected to another input terminal of the switch unit, and the output terminal of the switch unit is connected to the output terminal of the reference voltage generation circuit.

In the first and second embodiments of the present invention, there is a case where the drive unit 2 and the plural candidate drive units in the plural drive unit candidate circuits are turned on at the same time. In this case, it is possible to let one of the drive unit and the plural candidate drive units be mainly in charge by selecting the transistors having different threshold voltage values.

Of course it is also possible to let only one of the drive unit and plural candidate drive units in the plural drive unit candidate circuits be turned on to work and the others not be turned on to work. For example, in order to achieve this purpose, based on the first and second embodiments of the present invention, a switch unit may be disposed between the drive unit 2 and the power supply voltage VDDA, and in each of the drive unit candidate circuits, the control voltage output from the switch control unit to the switch unit is output to the switch units in the other drive unit candidate circuits after being converted.

Furthermore, with regard to the various elements used in the above embodiments, those practiced in the art can understand that it is possible to replace the P-channel field effect transistor with an N-channel field effect transistor, and replace the N-channel field effect transistor with a P-channel field effect transistor; it is possible to replace the various elements with other elements able to achieve the same functions; or it is possible to change the connection among the various elements.

While the present invention is described with reference to the specific embodiments chosen for purpose of illustration, it should be apparent that the present invention is not limited to these embodiments, but numerous modifications could be made thereto by those skilled in the art without departing from the basic concept and scope of the present invention.

The present application is based on Chinese Priority Patent Application No. 201010131284.X filed on Mar. 11, 2010, the entire contents of which are hereby incorporated by reference.

What is claimed is:

1. A reference voltage generation circuit comprising a reference voltage generation and comparison unit and a drive unit, wherein, the reference voltage generation and comparison unit generates a first reference voltage; an output terminal of the reference voltage generation and comparison unit is connected to the drive unit; an output reference voltage output from an output terminal of the reference voltage generation circuit is input into the reference voltage generation and comparison unit as a negative feedback voltage; after being compared with the first reference voltage generated by the reference voltage generation and comparison unit, the output reference voltage is output from the output terminal of the reference voltage generation and comparison unit to the drive unit; when a power supply voltage of the reference voltage generation circuit is greater than a first turn-on voltage, after being driven by the drive unit, the output reference voltage is output from an output terminal of the drive unit to the output terminal of the reference voltage generation circuit so that the output reference voltage output from the output terminal of the reference generation circuit is stabilized at a level of the first reference voltage generated by the reference voltage generation and comparison unit, wherein, the reference voltage generation circuit further comprises M drive unit candidate circuits connected to the output terminal of the reference voltage generation and comparison unit, wherein, a first drive unit candidate circuit to an M-th drive unit candidate circuit, amongst the M drive unit candidate circuits, correspond to the first turn-on voltage to an M-th turn-on voltage; the first turn-on voltage to the M-th turn-on voltage are gradually stepped down in series;

an N-th drive unit candidate circuit amongst the M drive unit candidate circuits is turned on to work when the power supply voltage of the reference voltage generation circuit is less than an N-th turn-on voltage, wherein, the output reference voltage output from the output terminal of the reference voltage generation circuit is input into the reference voltage generation and comparison unit as a negative feedback voltage; after being compared with the first reference voltage generated by the reference voltage generation and comparison unit, the output reference voltage is output from the output terminal of the reference voltage generation and comparison unit to the M drive unit candidate circuits; when the power supply voltage of the reference voltage generation circuit is less than the N-th turn-on voltage, after being driven by at least the N-th drive unit candidate circuit, the output reference voltage is output from at least the N-th drive unit candidate circuit to the output terminal of the reference voltage generation circuit, wherein, M is an integer number greater than or equal to 2, and N is an integer number greater than or equal to 1 and less than or equal to M, wherein the reference voltage generation and comparison unit includes a first transistor and a second transistor connected serially to the first transistor, and the output reference voltage is fed to the gates of the first transistor and second transistor, wherein the drive unit includes a drive transistor, an output of the N-th drive unit candidate circuit is connected to the drive transistor of the drive unit and is output to the second transistor of the reference voltage generation and comparison unit, and wherein any one of the M drive unit candidate circuits is turned on and an output voltage of the turned-on drive unit candidate circuit is fed back to the reference voltage generation and comparison unit and output from the reference voltage generation circuit.

2. The reference voltage generation circuit according to claim 1, wherein, each of the drive unit candidate circuits includes a candidate drive unit, a switch unit, and a switch control unit, wherein, one input terminal of the switch unit is connected to the power supply voltage of the reference voltage generation circuit; an output terminal of the switch control unit is connected to another input terminal of the switch unit; the output terminal of the switch unit is connected to a power supply input terminal of the candidate drive unit; the output terminal of the reference generation and comparison unit is connected to a control terminal of the candidate drive unit; and an output terminal of the candidate drive unit is connected to the output terminal of the reference voltage generation circuit, when the power supply voltage of the reference generation circuit is less than the N-th turn-on voltage, at least in the N-th drive unit candidate circuit, the output terminal of the switch control unit outputs a control voltage to control the switch unit to connect the candidate drive unit to the power supply voltage of the reference voltage generation circuit so that the candidate drive unit is turned on to work.

3. The reference voltage generation circuit according to claim 2, wherein:

the switch control unit in each of the drive unit candidate circuits includes an electric current mirror circuit, a voltage pull-down circuit, and a turn-on voltage control circuit, and two input terminals of the electric current mirror circuit are connected to the power supply voltage of the reference voltage generation circuit; one output terminal of the electric current mirror circuit is connected to one input terminal of the voltage pull-down circuit and serves as the output terminal of the switch control unit; and another output terminal of the electric current mirror circuit is connected to another input terminal of the voltage pull-down circuit via the turn-on voltage control circuit.

4. The reference voltage generation circuit according to claim 3, wherein:

in the switch control unit of each of the drive unit candidate circuits, the voltage pull-down circuit is composed of one of an electric current source circuit, a mirror electric current source circuit generated by an electric current source circuit, and a pull-down resistor.

5. The reference voltage generation circuit according to claim 3, wherein:

in the switch control unit of each of the drive unit candidate circuits, the electric current mirror circuit is composed of a first field effect transistor and a second filed effect transistor having a same type, wherein, sources of the first field effect transistor and the second field effect transistor are connected to the power supply voltage of the reference voltage generation circuit; and gates of the first field effect transistor and the second field effect transistor are connected to a drain of the second field effect transistor, the turn-on voltage control circuit is composed of a field effect transistor or plural field effect transistors connected in cascade, wherein, corresponding gates and drains of adjacent of the field effect transistors are connected to each other, the voltage pull-down circuit is composed of a third depletion mode field effect transistor and a fourth depletion mode field effect transistor, wherein, a source and a gate of the third depletion mode field effect transistor are connected to ground; a drain of the third depletion mode field effect transistor is connected to a drain of the first field effect transistor in the electric current mirror circuit and serves as the output terminal of the switch control unit; a source and a gate of the fourth depletion mode field effect transistor are connected to ground; and a drain of the fourth depletion mode field effect transistor is connected to an output terminal of the turn-on voltage control circuit; and the turn-on voltage of each of the drive unit candidate circuits is equal to a sum of threshold voltages of a field effect transistor forming the turn-on voltage control circuit and the second field effect transistor forming the electric current mirror circuit.

6. The reference voltage generation circuit according to claim 3, wherein:

there is a voltage-dividing circuit connected between the power supply voltage of the reference voltage veneration circuit and ground the voltage-dividing circuit has plural voltage-dividing output terminals whose number is M equal to the number of the drive unit candidate circuits; the M voltage-dividing output terminals output M gradually-stepping-up output voltages in series; first input terminals of the switch control units in the first drive unit candidate circuit to the M-th drive unit candidate circuit are sequentially connected to the corresponding voltage-dividing terminals outputting gradually-stepping-up output voltages in series; second input terminals of the switch control units in the first drive unit candidate circuit to the M-th drive unit candidate circuit are connected to the reference voltage; and the switch control units compare the voltages input from the two input terminals, and then output the control voltages from the output terminals of the switch control units to the corresponding switch units, wherein, in each of the drive unit candidate circuits, the reference voltage connected to the second input terminal of the switch control unit is equal to a product of the turn-on voltage of this drive unit candidate circuit and a voltage-dividing coefficient of the voltage-dividing output terminal connected to the first input terminal of the switch control unit in this drive unit candidate circuit; and the voltage-dividing coefficient of the voltage-dividing output terminal is equal to a ratio of the voltage output from the voltage-dividing output terminal to the power supply voltage.

7. The reference voltage generation circuit according to claim 6, wherein:

the second input terminal of the switch control unit in each of the drive unit candidate circuits is connected to the output terminal of the reference voltage generation circuit.

8. The reference voltage generation circuit according to claim 1, wherein, each of the drive unit candidate circuits includes a candidate drive unit, a switch unit, and a switch control unit, wherein, a power supply input terminal of the candidate drive unit is connected to the power supply voltage; the output terminal of the reference voltage generation and comparison unit is connected to a control unit of the candidate drive unit; an output terminal of the candidate drive unit is connected to one input terminal of the switch unit; an output terminal of the switch control unit is connected to another input terminal of the switch unit; and an output terminal of the switch unit is connected to the output terminal of the reference voltage generation circuit, when the power supply voltage of the reference voltage generation circuit is less than the N-th turn-on voltage, at least in the N-th drive unit candidate circuit, the output terminal of the switch control unit outputs a control voltage to control the switch unit to connect the candidate drive unit to the power supply voltage of the reference voltage generation circuit so that the candidate drive unit is turned on to work.

9. The reference voltage generation circuit according to claim 1, wherein:

the drive unit and each of the candidate drive units are composed of transistors having various threshold voltages.

10. The reference voltage generation circuit according to claim 9, wherein:

with regard to the first drive unit candidate circuit to the M-th drive unit candidate circuit, the threshold voltages of the transistors forming the candidate drive units in the M drive unit candidate circuits gradually step down in series, and the threshold voltage of the transistor forming the drive unit is greater than that of the transistor forming the first candidate drive unit.

11. The reference voltage generation circuit according to claim 1, wherein:

in each of the drive unit candidate circuits, the switch unit is composed of a transistor.

* * * * *